US008968496B2

(12) United States Patent
Larsson et al.

(10) Patent No.: US 8,968,496 B2
(45) Date of Patent: Mar. 3, 2015

(54) METHOD OF PRESS HARDENING A STEEL SHEET BLANK

(75) Inventors: Jan Larsson, Lulea (SE); Paul Akerstrom, Lulea (SE); Daniel Berglund, Norrfjarden (SE)

(73) Assignee: Gestamp Hardtech AB, Lulea (SE)

( * ) Notice: Subject to any disclaimer, the term of this patent is extended or adjusted under 35 U.S.C. 154(b) by 358 days.

(21) Appl. No.: 13/261,432

(22) PCT Filed: Feb. 17, 2011

(86) PCT No.: PCT/SE2011/000027

§ 371 (c)(1), (2), (4) Date: Oct. 23, 2012

(87) PCT Pub. No.: WO2011/115539

PCT Pub. Date: Sep. 22, 2011

(65) Prior Publication Data

US 2013/0048160 A1 Feb. 28, 2013

(30) Foreign Application Priority Data

Mar. 16, 2010 (SE) ..... 1000236

(51) Int. Cl.

| | |
|---|---|
| ***C21D 8/02*** | (2006.01) |
| ***C21D 1/673*** | (2006.01) |
| ***B21D 22/02*** | (2006.01) |
| ***C21D 1/18*** | (2006.01) |

(52) U.S. Cl.

CPC ..... *C21D 1/673* (2013.01); *B21D 22/022* (2013.01); *C21D 1/18* (2013.01)

USPC ..... 148/649; 148/653; 148/654; 148/639; 148/643; 72/379.2; 72/379.4

(58) Field of Classification Search

None

See application file for complete search history.

(56) References Cited

U.S. PATENT DOCUMENTS

2010/0095733 A1* 4/2010 Salamon et al. ..... 72/342.5

FOREIGN PATENT DOCUMENTS

| | | | |
|---|---|---|---|
| DE | 10 2005 032113 | B3 | 2/2007 |
| EP | 1 180 470 | A1 | 2/2002 |
| EP | 1 715 066 | A1 | 10/2006 |
| WO | WO2006/038868 | A1 | 4/2006 |
| WO | WO2008/104360 | A1 | 9/2008 |

OTHER PUBLICATIONS

Introduction to Steel Heat Treatment, Steel Heat Treating Fundamentals and Processes. vol. 4A, ASM Handbook, ASM, International, 2013, pp. 1-6.*

* cited by examiner

*Primary Examiner* — Deborah Yee
(74) *Attorney, Agent, or Firm* — Mark P. Stone

(57) ABSTRACT

In a press-hardening plant, a contact-cooling press (12) is provided between the furnace (11) and the press-hardening press (13). Preselected parts of the blank (18) are contact-cooled such that corresponding parts of the finished product are softer and display a lower yield point.

6 Claims, 1 Drawing Sheet

METHOD OF PRESS HARDENING A STEEL SHEET BLANK

FIELD OF THE INVENTION

The invention relates to a press-hardening plant and to a method of press hardening a sheet-steel blank such that the finished product is provided with one or more areas having a lower yield point than the rest of the product.

BACKGROUND OF THE INVENTION

It is possible to manufacture press-hardened products displaying very high strength. One common field of application is in the vehicle industry and it is possible to control deformation and reduce the risk of crack formation in the event of a collision by providing the product with softer portions having a lower yield point than the rest of the product. WO 2006/038868 describes the use of gaps and EP 1 715 066 A1 and DE 10 2005 032113 B3 describe the heating of selected portions of the cooled tool pair. In both cases, the cooling rate of the selected portions during the press-hardening operation is reduced, resulting in softer portions. According to EP 1 180 470 B1, softer portions are obtained by preventing these portions from being heated to the austenitising temperature in the furnace or by cooling them by air blowing before the press-hardening operation.

Aim of the Invention

The aim of the invention is to provide a simple process with a short cycle time resulting in geometrically well-defined portions having well-defined geometry and a well-defined reduced lower ultimate tensile strength and yield point than the rest of the product.

BRIEF DESCRIPTION OF THE INVENTION

A press-hardening plant according to the invention includes a press situated between the furnace and the press-hardening press for the contact cooling of predetermined parts of the blank before the blank is formed and hardened in the press-hardening press.

A method according to the invention consists in that, after the blank has been heated to the austenitising temperature, selected parts of the blank are contact-cooled to a temperature which promotes ferrite growth during the subsequent transfer to the press-hardening press and during the press-hardening operation.

The invention is defined by the claims.

DESCRIPTION OF ILLUSTRATED EMBODIMENT OF THE INVENTION

Figure 1:
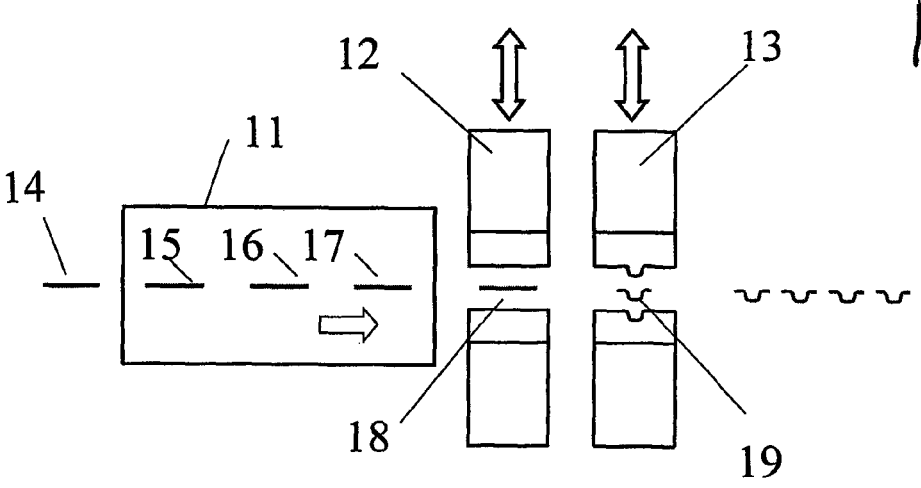
FIG. 1 is a diagrammatic representation of a press-hardening plant according to the invention.

FIG. 1 is a diagrammatic side view of a heating device in the form of a furnace 11, a contact-cooling press 12 and a press-hardening press 13. A number of flat sheet-steel blanks 14-18 and a finished product 19 are shown.

Figure 2:
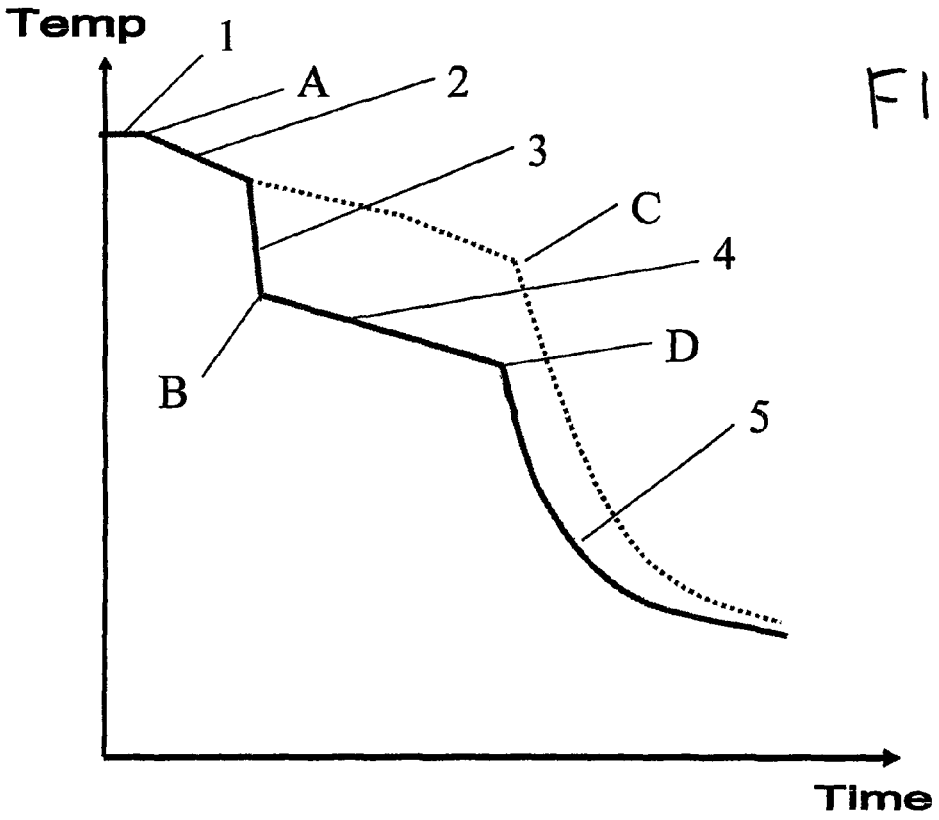
FIG. 2 is an example of a time-temperature diagram for the method according to the invention.

The blanks pass through the furnace and are heated such that the blank 18 is at the austenitising temperature when it leaves the furnace, i.e. a temperature usually slightly higher than 880 degrees Celsius. Normal austenitising temperature is approximately 900 degrees and up to 930 degrees. In the temperature diagram in FIG. 2, the temperature at which a blank emerges from the furnace is designated temperature A, in process step 1. During the transfer to the contact-cooling press 12, the temperature decreases slightly, indicated by process step 2 in the diagram. With the blank in the press 12, the press is activated and the blank is clamped in its tool pair such that a selected part or selected parts of the blank is/are cooled rapidly according to the temperature curve indicated by the solid line to the temperature B, e.g. which may be approximately or slightly lower than 700 degrees and should not be lower than 580 degrees. This rapid cooling is shown as process step 3 and should reduce the temperature by at least 150 degrees. The blank is then transferred to the press-hardening press 13, i.e. process step 4, and the cooled portion is then at the temperature D, whereas the remaining part of the blank has followed the temperature curve indicated by the dotted line and is at the temperature C, i.e. a normal temperature for press hardening. During the press-hardening operation in the cooled tools of the press 13, the blank is formed and hardened into the product 19 in the normal way. The part of the blank pre-cooled in the contact press has formed ferrite during process steps 3 and 4 and a corresponding part of the formed product therefore does not fully harden, but displays reduced hardness and a reduced yield point.

Cooling in the contact press 12, i.e. process step 3, normally takes approximately half a second and it can be difficult to achieve reproducibility in such a short time. The contact press can be heated such that the cooling time increases, e.g. to 1.5-2 seconds so that it is easier to control the cooling and the desired ferrite formation before the press-hardening operation. When the tools are heated in the press-hardening press in the conventional manner, there is increased tool wear. However, the blank is not formed in the contact press 12 and so there is no inconvenient wear. The transfer time between the two presses, i.e. process step 4, is usually 5-10 seconds in practice and should not be less than 15 seconds. The shortest possible transfer time in practice is a few seconds, which can be sufficient.

The contact press may consist of several parts having different temperatures or having different contact times so as to result in different ferrite growth and different degrees of hardness in different areas of the finished product. Another alternative is to have contact surfaces of different materials so as to result in different cooling.

The contact press has flat surfaces for contact with a flat blank. Alternatively, in addition to cooling the blank, the contact press may also preform the blank. It is also conceivable for the blank to be preformed before it enters the contact press.

The invention claimed is:

1. Method of press hardening a sheet-steel blank (18) such that a finished product (19) is provided with one or more areas having a lower yield point than the rest of the product, the steps of said method comprising: heating the blank (18) to the austenitising temperature, contact-cooling one or more selected parts of the blank to a temperature which promotes ferrite growth during a subsequent transfer of the blank to a press-hardening press (13) and during a subsequent press-hardening operation, and press-hardening the blank in said press-hardening press (13).

2. Method according to claim 1, wherein said one or more selected parts are contact-cooled by more than 150 degrees.

3. Method according to claim 2, wherein said one or more selected parts are contact-cooled to a temperature in excess of 580 degrees.

4. Method according to claim 1, wherein said one or more selected parts are contact-cooled for a period of less than 2 seconds.

5. Method according to claim 2, wherein said one or more selected parts are contact-cooled for a period of less than 2 seconds.

6. Method according to claim 3, wherein said one or more selected parts are contact-cooled for a period of less than 2 seconds.

* * * * *